US010269269B2

(12) United States Patent
Bloome

(10) Patent No.: US 10,269,269 B2
(45) Date of Patent: Apr. 23, 2019

(54) THREE-DIMENSIONAL ADVERTISING/PROMOTIONAL DISPLAY

(71) Applicant: 7SIDERS INC., Miramar, FL (US)

(72) Inventor: Jason Bloome, Miramar, FL (US)

( * ) Notice: Subject to any disclaimer, the term of this patent is extended or adjusted under 35 U.S.C. 154(b) by 0 days.

(21) Appl. No.: 15/901,611

(22) Filed: Feb. 21, 2018

(65) Prior Publication Data

US 2018/0268744 A1 Sep. 20, 2018

Related U.S. Application Data

(60) Provisional application No. 62/472,517, filed on Mar. 16, 2017.

(51) Int. Cl.
*G09F 1/06* (2006.01)
*G09F 13/22* (2006.01)

(52) U.S. Cl.
CPC ..... *G09F 1/065* (2013.01); *G09F 13/22* (2013.01); *G09F 2013/222* (2013.01)

(58) Field of Classification Search
CPC ..... G09F 1/06; G09F 1/065; G09F 2013/222
USPC ..... 40/124.19
See application file for complete search history.

(56) References Cited

U.S. PATENT DOCUMENTS 2,480,731 A * 8/1949 Haughwout ..... A45C 11/02 206/9
8,112,918 B1 * 2/2012 Crowell ..... B43K 23/001 40/107
2016/0257447 A1 * 9/2016 Mann ..... G09F 1/065

* cited by examiner

*Primary Examiner* — Gary C Hoge

(57) ABSTRACT

A fold-flat advertising/promotional display system which incorporates tabs and slits on pre-printed panels to form a unique three dimensional structure. The advertising/promotional display system incorporates nine cooperating members: a top and bottom panel, an interior panel and six side panels. This advertising/promotional display can be used for a wide variety of promotions, have many designs and be constructed of flexible and non-flexible materials. The advertising/promotional display system provides an exciting and surprising result which is not anticipated by the user. Additionally, this advertising/promotional display can incorporate LED lights and cut outs on top and side panels of object silhouettes.

14 Claims, 11 Drawing Sheets

THREE-DIMENSIONAL ADVERTISING/PROMOTIONAL DISPLAY

CROSS-REFERENCE TO RELATED APPLICATION

This application claims priority to U.S. Provisional Patent Application Ser. No. 62/472,517 for a "Three dimensional advertising/promotional display system" filed on Mar. 16, 2017 by Jason Bloome, the contents of which are incorporated herein by reference in its entirety.

FIELD

This invention relates to advertising/promotional display systems and, additionally, to advertising/promotional display systems which are visually exciting and interest generating products.

BACKGROUND

A large number of consumer goods and services has fueled the growth of promotional systems to advertise these products. Advertisers with limited advertising dollars are required to capture consumer attention with affordable promotional displays which are visually unique and exciting. Novelty promotional and advertising systems which involve components which fold flat and convert from two dimensional to three dimensional objects when activated or assembled are visually attractive, eye-catching and have the added benefit of increasing the surface area on which to print advertising material.

Although many advertising/promotional displays have been created that convert flat advertising/promotional displays to three dimensional systems these systems frequently involve complex folding systems, elastic bands and flexible materials which is difficult to assembly, costly to produce and prevents the use of rigid, non-flexible materials. Oftentimes, they fail to generate the desired interest by the consumer and fail to justify the production cost to the advertiser.

Other advertising/promotional displays have attempted to generate consumer interest with unique images or indicia as part of the display. However, these advertising/promotional displays fail to generate sufficient consumer interest when the consumer is not involved in the activation of the promotional item.

Additionally, increasing consumer demand requires promotional/advertising products which are unique and produce a surprising visual result.

What is needed, therefore, is a visually attractive, interest generating pre-printed advertising/promotional product which can be reproduced at a reasonable cost.

SUMMARY

The above and other needs are met by a visually attractive, interest generating pre-printed advertising/promotional product which can be reproduced at a reasonable cost.

An object of the present invention is to have a visually attractive, interest generating printed advertising/promotional product which utilizes a unique tab, slit and pivot system allowing the invention to be made of various flexible and non-flexible materials (including but not limited to die or laser cuttable plastic, light to heavyweight cardstock, cardboard and thin wood or metal).

Another object of the present invention is to have a visually attractive, interest generating pre-printed advertising/promotional product having the characteristics described above which is capable of mass production and assembly.

Another object of the present invention is to have a visually attractive, interest generating pre-printed advertising/promotional product having the characteristics described above which can be widely varied for satisfying diverse consumer interests.

Another object of present invention is to have a visually attractive, interest generating pre-printed advertising/promotional product which is unique, eye-catching and changes from a two dimensional display to a three dimensional display in response to action by the consumer.

By employing the present invention, all of the difficulties and inabilities of the prior art are eliminated and a unique, hands-on, printed, visually exciting and interest generating fold-flat three-dimensional advertising/promotional product is attained.

These desirable results are achieved in the present invention by using a unique, pre-printed fold-flat three-dimensional promotional system which does not involve complex folds nor require elastic bands.

The present invention consists of the following components: a top and bottom panel, an interior panel and side panels.

The assembly consists of slotting side panels upwards through slits on the bottom panel, slotting side-panels with slits through tabs on arm members of the interior panel, aligning the slits on the top panel with tabs at the top of the side panels, applying adhesive to the upper surface of tabs on arm members of the interior panel, and slotting downwards the top panel affixing it to the interior panel.

The unique tab, slit and pivot design which allows the invention to move between a flat, compacted position and a second, three dimensional fully extended position provides an exciting and surprising visual result for the consumer who activates the invention by holding the rim of the top pane, lifting and slightly shaking the structure. The bottom panel slides downwards, pulling down side panels which pivot on arm members of the interior panel converting the flat, two dimensional invention into a visually interesting, eye-catching three dimensional structure. In this way, the consumer has an active role in physically creating and enjoying the display being presented.

The unique tab, slit and pivot design allows the invention to be composed of a variety and combination of flexible and non-flexible material including, but not limited to, die or laser cuttable plastic, vellum, cardstock, chipboard, cardboard, wood and metal.

In order to provide a further alternate visually exciting and interest generating configuration, various cut out zones may be formed in the top and side panels for object silhouettes. In addition, circular cut-outs in the top panel could be used to accommodate pens and pencils.

Additionally, this unique invention has a bottom panel with a circular cut-out which, in some embodiments, allows for the easy insertion of a LED light which is attached with an adhesive to the underside of the interior arm member. When the structure is erect the consumer can reach through the circular cut out on the bottom panel to turn on and off the LED. By using an LEDs and side panels cut-outs additional visual excitement and interest can be attained.

The invention accordingly comprises an article of manufacture possessing the features, properties, and relation of elements which will be exemplified in the article hereinafter described, and the scope of the invention will be indicated in the claims.

In a first aspect, a display structure includes: a bottom panel including a plurality of slits formed through the bottom panel and arranged around a center of the bottom panel; a top panel including a plurality of slits formed through the top panel and arranged around a center of the top panel; a plurality of side panels shaped to slidably fit through the slits formed through the bottom panel and the slits formed through the top panel, the plurality of side panels including lateral tabs located on a lower end of the plurality of side panels to prevent the plurality of side panels from passing through the plurality of slits formed through the bottom panel, the plurality of side panels further including a horizontal slit adjacent upper ends of the plurality of side panels; and an interior panel attached to the top panel and including a plurality of arms extending radially from the interior panel, the plurality of arms shaped to fit through the horizontal slits formed through the plurality of side panels. In a collapsed configuration the bottom panel is located adjacent to the top panel such that the plurality of side panels are capable of pivoting about the arms of the interior panel to lie flat underneath the bottom panel. In a deployed configuration, the bottom panel is slidably moved along lengths of the plurality of side panels towards a bottom of the side panels to maintain the plurality of side panels in an upright position.

In one embodiment, the plurality of side panels are oriented radially around a center of the bottom panel and a center of the top panel.

In another embodiment, the interior panel is attached to the top panel at ends of the plurality of arms extending radially from the interior panel and through the horizontal slits of the plurality of side panels.

In yet another embodiment, the display structure further includes a plurality of alternating side panels shaped to slidably fit through the slits formed through the bottom panel and the slits formed through the top panel, the plurality of side panels including diagonal cuts on a lower end of the plurality of alternating side panels, the plurality of alternating side panels including a horizontal slit adjacent upper ends of the plurality of alternating side panels.

In one embodiment, the display structure further includes an LED attached to an underside of the interior panel for illuminating the display structure when the display structure is in the deployed configuration.

In another embodiment, the display structure further includes one or more circular cutouts formed through the top panel and interior panel for receiving an object through the one or more circular cutouts.

In yet another embodiment, the display structure further includes printed indicia located on one of the top panel and plurality of side panels, the printed indicia selected from the group consisting of text, alphanumeric messages, visual images, pictures, graphics, symbols, and logos.

In one embodiment, the bottom panel, top panel, interior panel, and side panels are formed from one of plastic, vellum, cardstock, chipboard, cardboard, wood, and metal.

In another embodiment, the plurality of side panels comprise at least six side panels circularly arranged around centers of the top panel and interior panel.

In yet another embodiment, the plurality of side panels comprise at least three side panels, and wherein the plurality of alternating side panels comprise at least three alternating side panels, the plurality of side panels and plurality of alternating side panels arranged alternatively around centers of the top panel and the interior panel.

In one embodiment, the display structure further includes an elongate slit formed through the top panel and interior panel and shaped to receive promotional material through the top panel and interior panel.

In another embodiment, the display structure is moved from the deployed configuration to the collapsed configuration by: sliding the bottom panel towards the top panel and interior panel along lengths of the plurality of side panels; pivoting lower ends of the plurality of alternating side panels towards a center of the display structure such that the plurality of alternating side panels lie flat against an underside of the interior panel; and pivoting lower ends of the plurality of side panels towards the center of the display structure such that the plurality of side panels lie flat against the plurality of alternating side panels and underside of the interior panel.

In yet another embodiment, in the deployed configuration a hollow interior of the display structure is formed between the bottom panel, the interior panel, and the plurality of side panels.

In a second aspect, a display structure includes: a bottom panel including a plurality of slits formed through the bottom panel and arranged around a center of the bottom panel; a top panel including a plurality of slits formed through the top panel and arranged around a center of the top panel; a plurality of first side panels shaped to slidably fit through the slits formed through the bottom panel and the slits formed through the top panel, the plurality of first side panels including lateral tabs located on a lower end of the plurality of side panels and having a width greater than a width of the plurality of slits formed through the bottom panel to prevent the plurality of side panels from passing through the plurality of slits formed through the bottom panel, the plurality of side panels further including a horizontal slit adjacent upper ends of the plurality of side panels; a plurality of second side panels arranged alternately with the plurality of first side panels and shaped to slidably fit through the slits formed through the bottom panel and the slits formed through the top panel, the plurality of first side panels including diagonal cuts located on a lower end of the plurality of side panels and having a width less than a width of the plurality of slits formed through the bottom panel, the plurality of side panels further including a horizontal slit adjacent upper ends of the plurality of side panels; an interior panel attached to the top panel and including a plurality of arms extending radially from the interior panel, the plurality of arms shaped to fit through the horizontal slits formed through the plurality of first side panels and the plurality of second side panels. In a collapsed configuration the bottom panel is located adjacent to the top panel such that the plurality of first side panels and plurality of second side panels are capable of pivoting about the arms of the interior panel to lie flat underneath the bottom panel. In a deployed configuration, the bottom panel is slidably moved along lengths of the plurality of side panels towards a bottom of the side panels to maintain the plurality of first side panels and plurality of second side panels in an upright position.

In a third aspect, a display structure includes: a bottom panel including a plurality of slits formed through the bottom panel and arranged around a center of the bottom panel; a top panel including a plurality of slits formed through the top panel and arranged around a center of the top panel; a plurality of side panels shaped to slidably fit through the slits formed through the bottom panel and the slits formed through the top panel, the plurality of side panels including lateral tabs located on a lower end of the plurality of side panels to prevent the plurality of side panels from passing through the plurality of slits formed through the bottom panel, the plurality of side panels further including a horizontal slit adjacent upper ends of the plurality of side panels; and a plurality of arms shaped to fit through the horizontal slits formed through the plurality of side panels, the plurality of arms attached to the top panel. In a collapsed configuration the bottom panel is located adjacent to the top panel such that the plurality of side panels are capable of pivoting about the plurality of arms to lie flat underneath the bottom panel. In a deployed configuration, the bottom panel is slidably moved along lengths of the plurality of side panels towards a bottom of the side panels to maintain the plurality of side panels in an upright position.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

The three-dimensional (3D) advertising/promotional display (hereinafter referred to as "3D structure") of the present disclosure allow for construction comprised of cooperating panels connected by tabs and slits which fold flat and, when erected, assume a 3D shape with a hollow interior. Each of the panels can feature indicia or visual display and cut-outs. If desired, the hollow interior can accommodate a LED light.

By referring to FIGS. 1-12, along with the following detailed discussion, the preferred constructions and operation of a plurality of alternate embodiments of the present invention can best be understood. In each of these embodiments, 3D structure 100 is fully disclosed which is capable of being easily moved between a substantially flat configuration into a fully erect, three-dimensional configuration.

Although this disclosure and the associated drawings fully detail several alternate preferred embodiments of the present invention, further alternate embodiments can be implemented without departing from the scope of this invention. Consequently, it is to be understood that the following disclosure is provided for exemplary purposes only and is not intended as a limitation of the present invention. Furthermore, all alternate embodiments which are obvious modifications of this disclosure are intended to be encompassed within the scope of the present invention.

Figure 1:
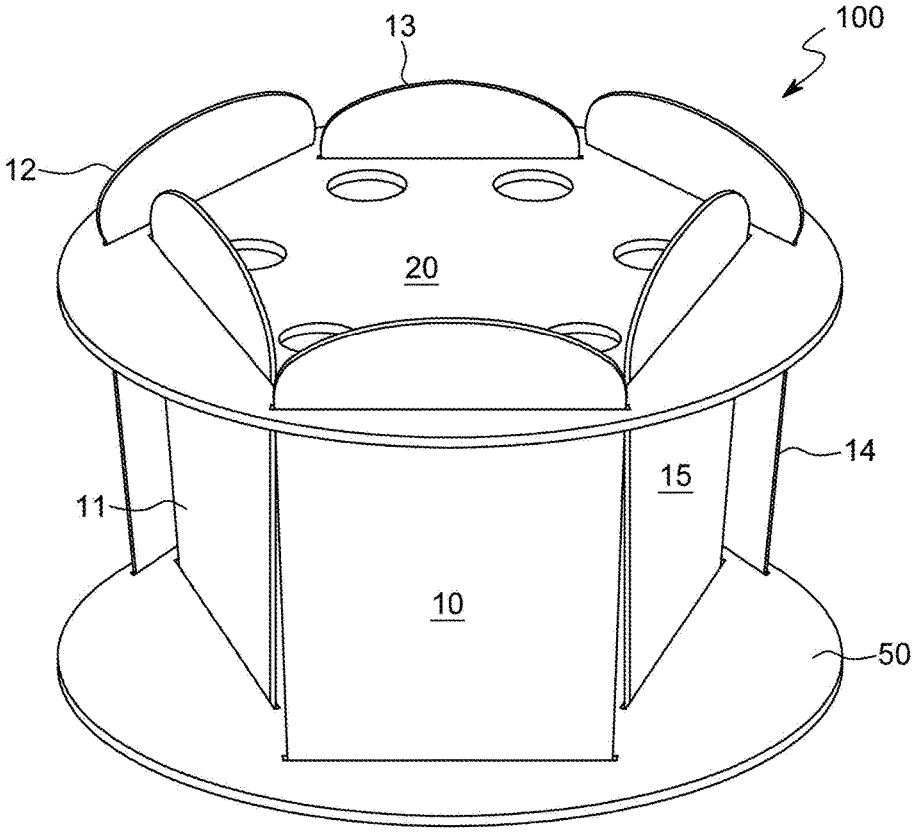
FIG. 1 is a perspective view of the representative embodiment of the 3D advertising/promotional product depicting the fully erected assembled structure.
Figure 2:
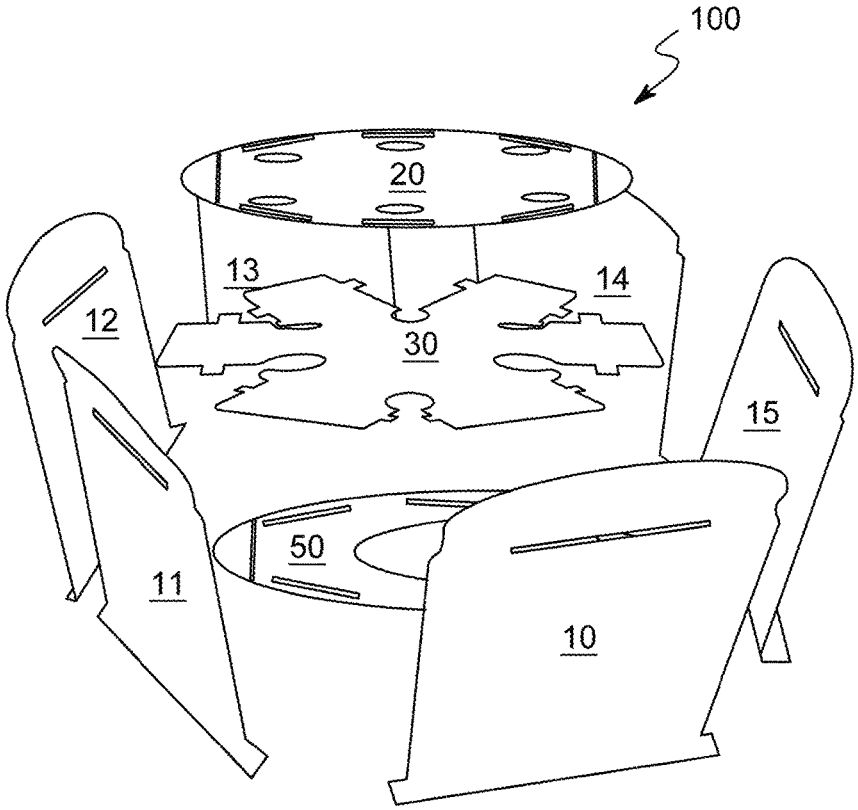
FIG. 2 is an exploded perspective view of the representative embodiment of the 3D advertising/promotional product.

A representative embodiment of the 3D structure 100 when erected is shown in FIG. 1. 3D structure 100 as shown in FIG. 2 consists of six side panels 10, 11, 12, 13, 14, 15, a bottom panel 50, a top panel 20 and an interior panel 30 with six arm members.

Figure 3:
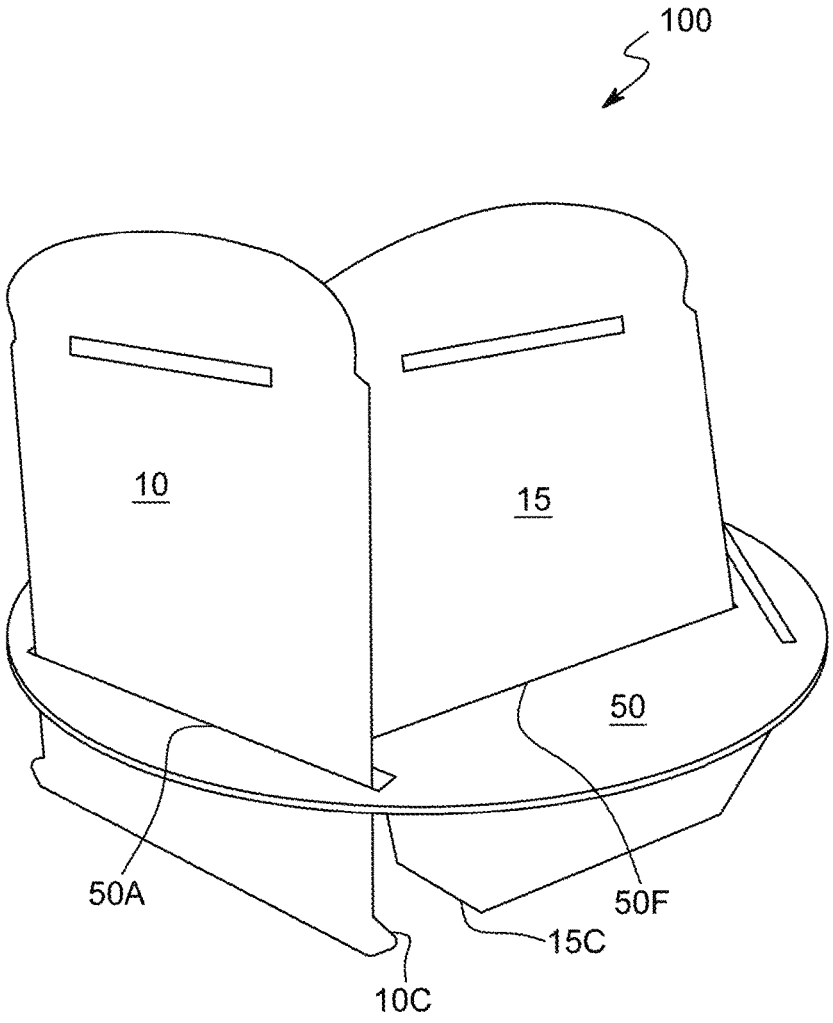
FIG. 3 is a side view of two side panels slotted through slits on the bottom panel of the partially assembled structure.
Figure 4:
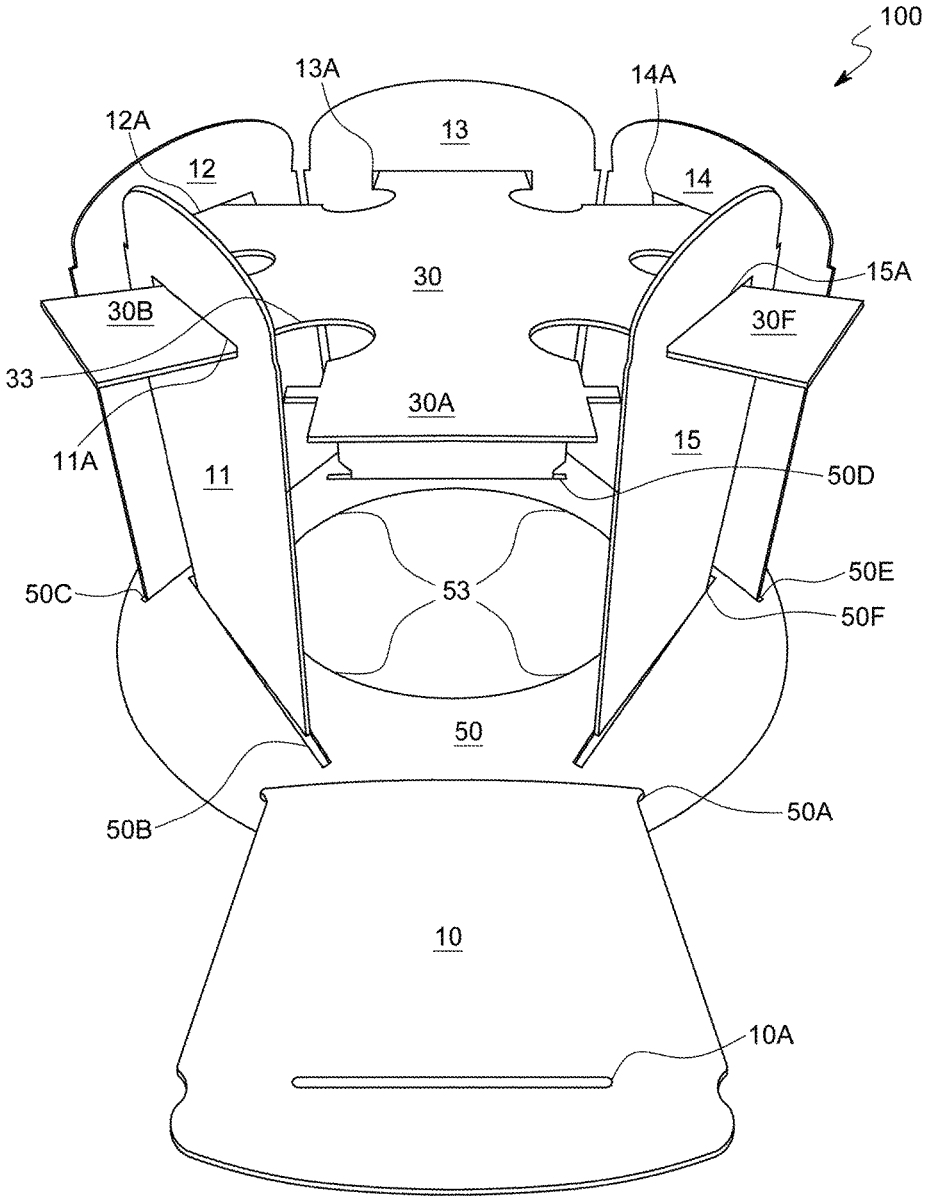
FIG. 4 is a side view of the interior of the partially assembled structure with five of the side panels slotted onto arm members of the interior panel.

3D structure 100 is assembled, as shown in FIGS. 3 and 4, by slotting side panels upwards through slits on bottom panel 50. Side panels 11, 13 and 15 are slotted upwards through interior slits 50*b*, 50*d* and 50*f* and side panels 10, 12 and 14 are slotted upwards through exterior slits 50*a*, 50*c*, 50*e*.

Figure 5:
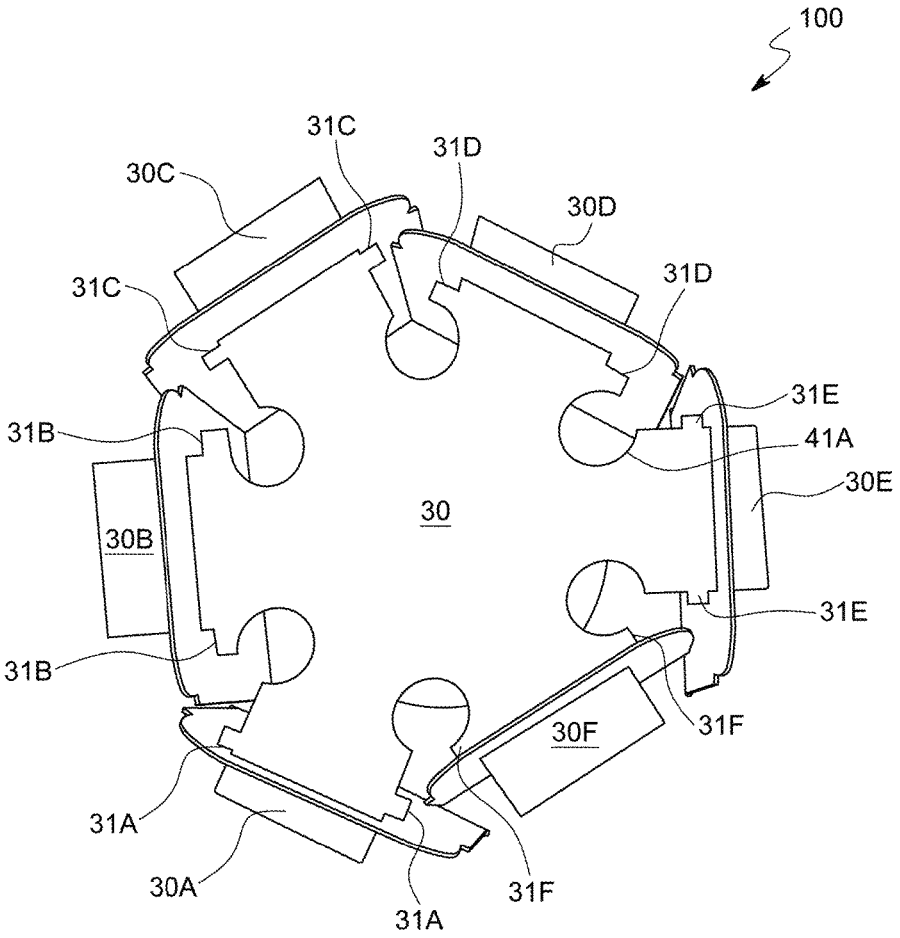
FIG. 5 is a top view of the partially assembled structure.

As shown in FIGS. 4 and 5, side panels 10, 11, 12, 13, 14, 15, are slotted onto interior panel 30 by slotting interior arm tabs 30*a*, 30*b*, 30*c*, 30*d*, 30*e*, and 30*f* through slits 10*a*, 11*a*, 12*a*, 13*a*, 14*a*, 15*a* (protruding tabs 30*c*, 30*d*, 30*e* are not visible in FIG. 4). As shown in FIG. 5, lateral extensions 31*a*, 31*b*, 31*c*, 31*d*, 31*e* and 31*f* on arms 30*a*, 30*b*, 30*c*, 30*d*, 30*e* and 30*f* of interior panel 30 prevent the side panels from sliding towards the center of interior panel 30 allowing, as shown in FIG. 6, side panel tabs 10*c*, 11*c*, 12*c*, 13*c*, 14*c* and 15*c* to align with slits 20*a*, 20*b*, 20*c*, 20*d*, 20*e* and 20*f* on top panel 20.

Figure 6:
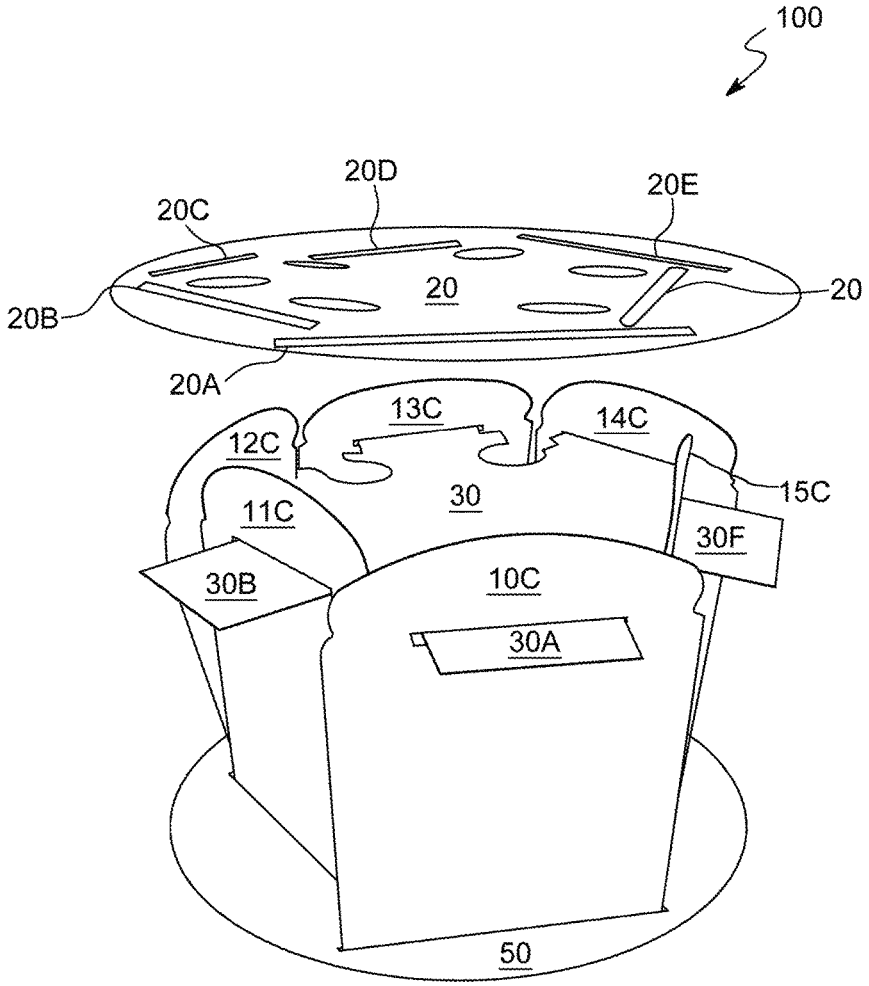
FIG. 6 is a side view of the interior of the partially assembled structure and of the top panel prior to adhesion to the upper surface of tabs on arm members of the interior panel.

Adhesive is applied to the upper surface of interior arm tabs 30*a*, 30*b*, 30*c*, 30*d*, 30*e* and 30*f*, shown in FIG. 5, and top panel 20 is slotted downwards onto side panel tabs 10*c*, 11*c*, 12*c*, 13*c*, 14*c* and 15*c*, as shown is FIG. 6, and attached to the interior arm tabs resulting in 3D structure 100, as shown in FIG. 1.

Note there are a variety of methods and materials known and used in art for adhesion including but to limited to hot glue, craft glue, spray adhesives, tape, gels, glue dots, rivets, magnets, staples, hook and loop (i.e. Velcro) and other adhesive substances or fasteners.

Figure 7:
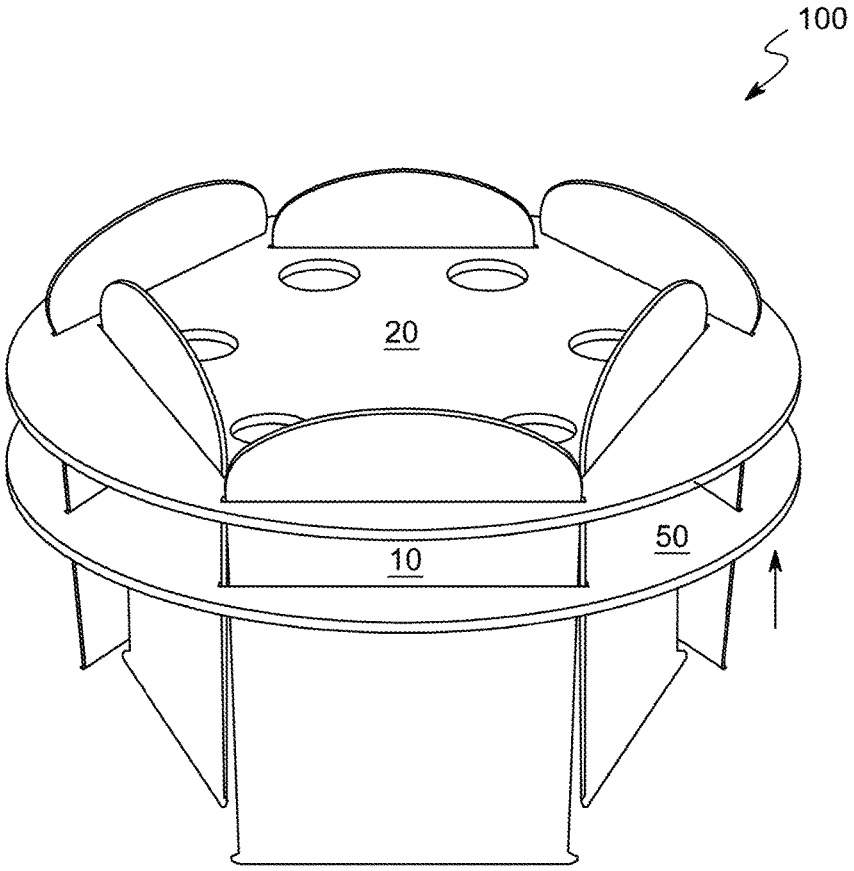
FIG. 7 is a side of view of the fully assembled structure with the bottom panel half-way up the side panels.
Figure 8:
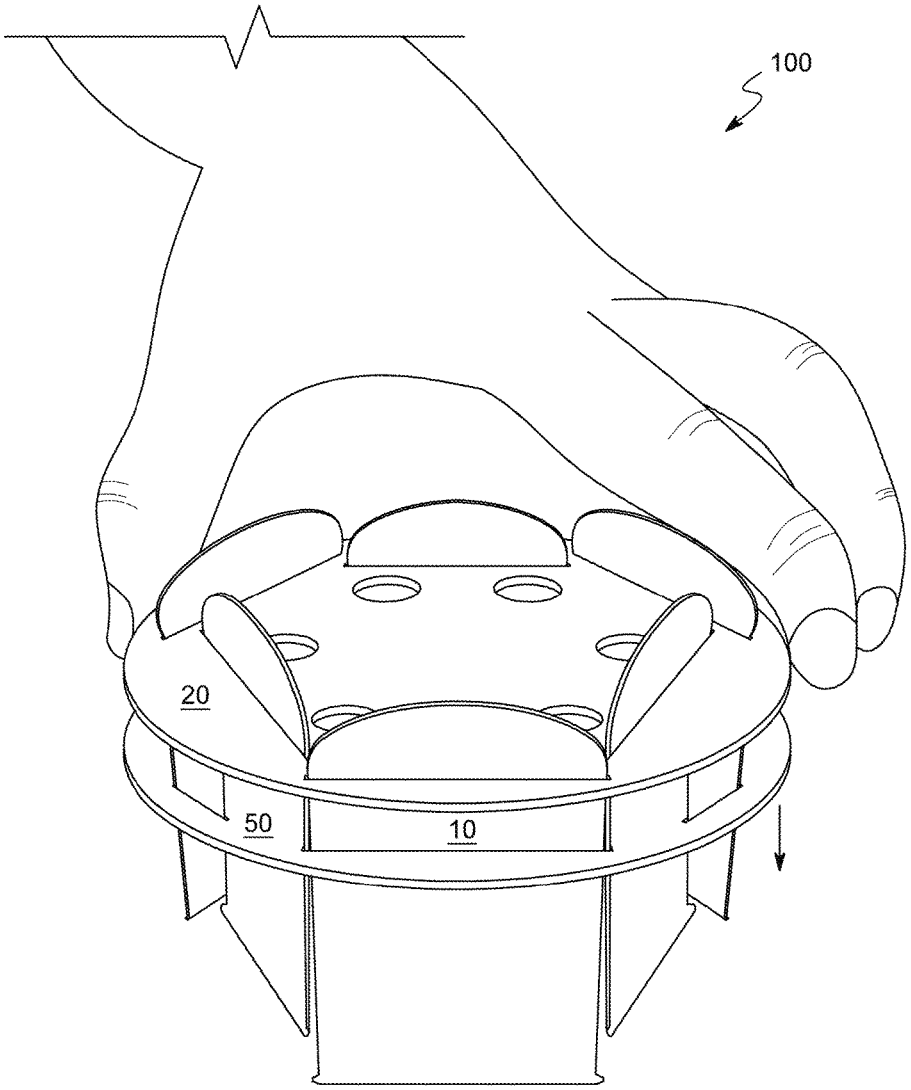
FIG. 8 is a side of view of the fully assembled structure being shaken, allowing the bottom panel to slide down the side panels.
Figure 9:
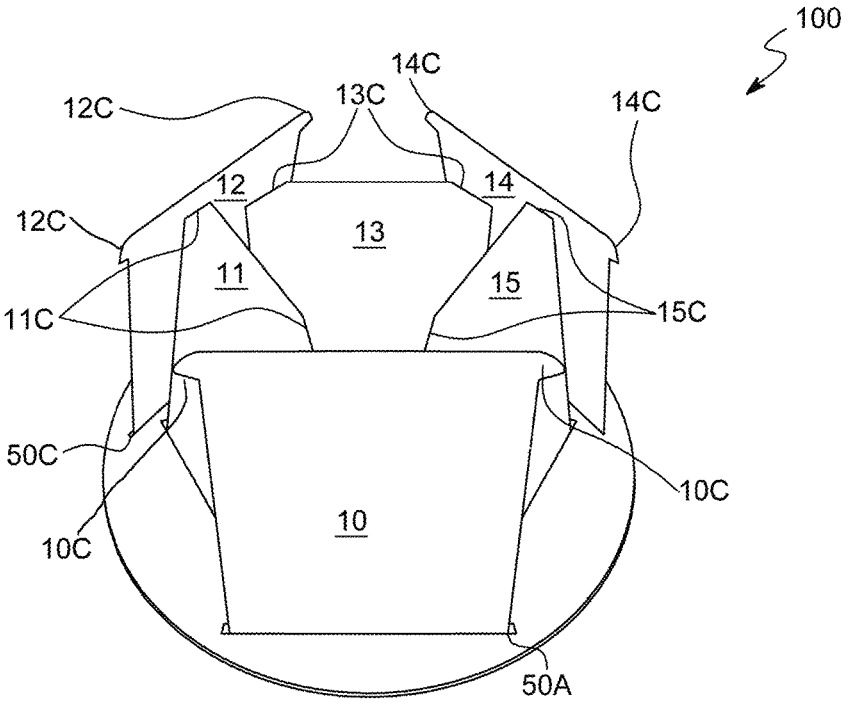
FIG. 9 is an upside down view of the fully assembled structure showing the side panels folding underneath the fully assembled structure.
Figure 10:
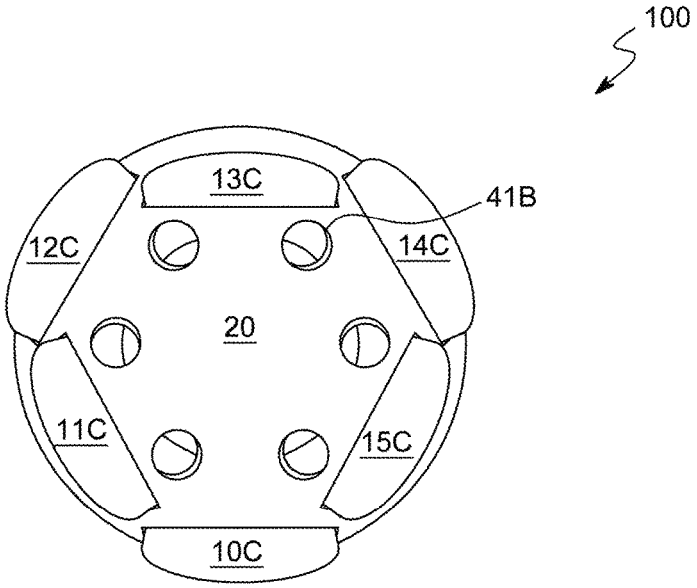
FIG. 10 is a top view of the fully collapsed assembled structure.

As shown in FIG. 6, side panels 10, 11, 12, 13, 14 and 15 are not physically attached to top panel 20 allowing them to pivot on arms of interior panel 30. 3D structure 100 is collapsed, as shown in FIG. 7, by sliding bottom panel 50 upwards towards top panel 20, turning 3D structure 100 upside down and stacking side panels 10, 11, 12, 13, 14 and 15, as shown in FIG. 9, on top of one another. 3D structure 100 when flat, as shown in FIG. 10, is erected by grasping the rim of top panel 20, lifting and, as shown in FIG. 8, slightly shaking the assembly causing bottom panel 50 to slide downwards pulling down side panels that unstack from underneath bottom panel 50.

As shown in FIG. 9, structural integrity is provided to 3D structure 100 by extensions 10*c*, 12*c* and 14*c* which extend laterally on both sides of the bottom of side panels 10, 12 and 14. The total length of the bottom of side panels 10, 12 and 14 plus lateral extensions 10*c*, 12*c* and 14*c* exceed the length of slits 50*a*, 50*c*, and 50*e* preventing bottom panel 50 from sliding off the assembly when 3D structure 100 is fully erect and upright.

Further embodiments include 3D structure 100 with a solid bottom panel and a circular cut-out in the top and interior panels resulting in a hollow interior when the structure is fully erected that can contain objects, including but not limited to office supplies, staples, paper clips, erasers, etc. or candies, chocolates or other giveways when used at weddings, concerts, at promotional events and/or vendor fairs.

Further embodiments include 3D structure 100 with a circular cut-out in the top panel that could be removed to reveal artwork on the top of the interior panel.

Further embodiments include 3D structure 100 with a partial cut-out on the top panel that could be lifted upwards or slide sideways to reveal artwork on the top of the interior panel.

As shown in FIG. 9, diagonal die cuts 11*c*, 13*c* and 15*c* on interior panels 11, 13 and 15 accommodate lateral extensions 10*c*, 12*c* and 14*c* on exterior side panels 10, 12 and 14 allowing side panels to stack and unstack without obstruction. See FIG. 3 for another view of lateral extension 10*c* and diagonal cut 15*c*. The side panel stacking sequence is stacking, in any order, the three interior side panels 11, 13 and 15 followed by stacking, in any order, the three exterior side panels 10, 12 and 14.

The unique tab, slit and pivot system allow 3D structure 100 to be made of a variety and combination of flexible and non-flexible materials including, but not limited to, die or laser cuttable plastic, vellum, cardstock, chipboard, cardboard, wood and metal.

In accordance with the present invention, any desired printed indicia or visual display can be formed in the top and six side panel receiving zones of 3D structure 100. In this regard, indicia or visual display may comprise one or more selected from the group consisting of messages and/or displays which consists of alphanumeric, visual, pictorial, graphic, symbols, logos and pictures. As a result, by employing 3D structure 100 of the present invention, any message or display desired by a sponsor for being conveyed to a consumer is easily achieved in a unique, visually exciting and interest-generating manner.

Figure 11:
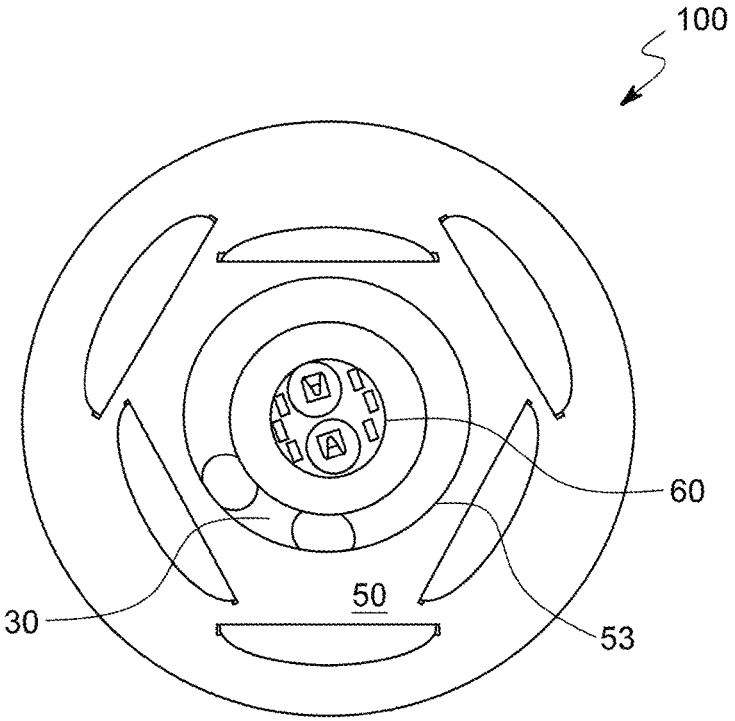
FIG. 11 is an upside down view of the interior of the fully erected invention with one embodiment featuring a LED attached to the underside of the interior arm member and FIG. 12 is a side view of one embodiment of the fully erected invention with side and top cut-outs.
Figure 12:
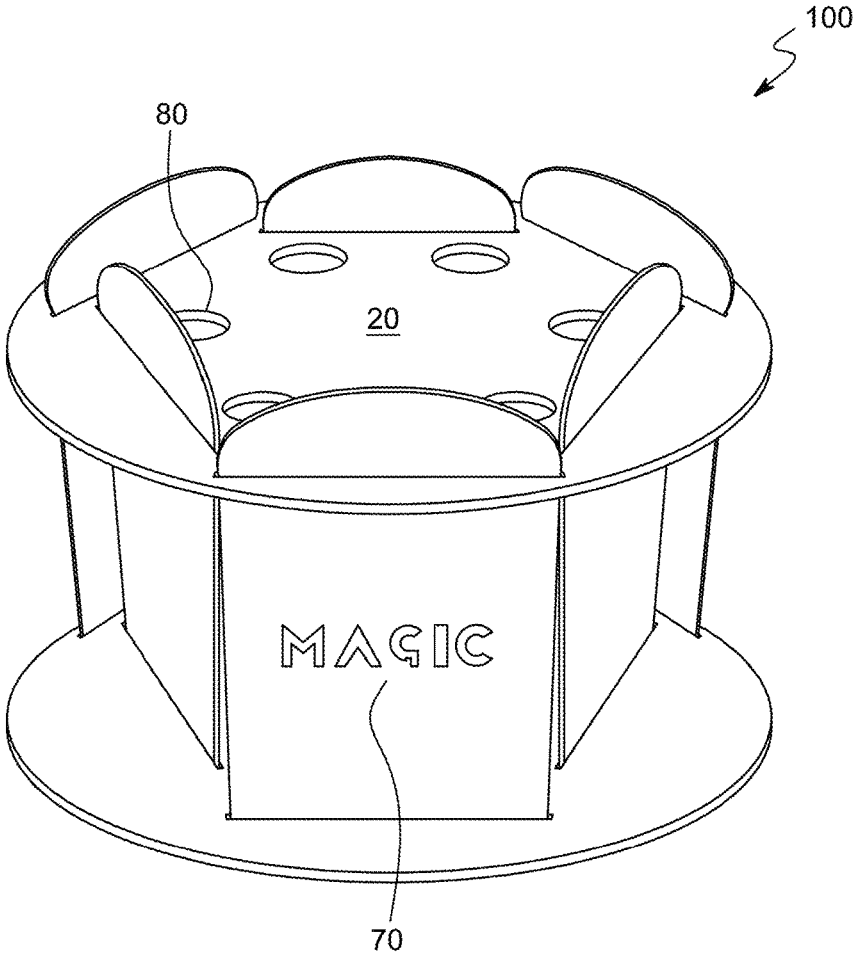

In addition, 3D structure 100, as shown in FIG. 4, has a hollow interior and a circular cut out 53 in the bottom of bottom panel 50. One embodiment of 3D structure 100, as shown in FIG. 11, is a LED attached to the underside of the interior arm member 30 which can be activated by an on and off switch by the consumer. Other embodiments feature top and side panel cut-outs of shapes, words and object silhouettes. See as an example, FIG. 12 top panel circular cut-outs 80 and side panel cut-out 70. Circular cut outs 41*a* on interior arm 30, as shown in FIG. 5, with matching cut outs 41*b*, as shown in FIG. 10, on top panel 20 allow 3D structure 100 to be, as one embodiment, a pen and pencil holder.

Further embodiments include 3D structure 100 with an interior LED in combination with translucent vellum of different colors adhered to the backside of side panels with cut-outs.

Another embodiment of 3D structure 100 could include construction out of die or laser cuttable thin aluminum or wood onto which inkjet images have been transferred.

In addition, 3D structure 100 may be configured in any size without departing from the scope of this invention. One preferred embodiment would be a 3D structure 100 small enough to fit in a standard size envelope to be used as an affordable promotional mailer. Another embodiment would be as a larger promotional/display at retail outlets, museums, art shows, trade shows, weddings, bars or as promotional give-away at schools, events or concerts.

It will thus be seen as the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A display structure comprising:

a bottom panel including a plurality of slits formed through the bottom panel and arranged around a center of the bottom panel;

a top panel including a plurality of slits formed through the top panel and arranged around a center of the top panel;

a plurality of side panels shaped to slidably fit through the slits formed through the bottom panel and the slits formed through the top panel, the plurality of side panels including lateral tabs located on a lower end of the plurality of side panels to prevent the plurality of side panels from passing through the plurality of slits formed through the bottom panel, the plurality of side panels further including a horizontal slit adjacent upper ends of the plurality of side panels;

an interior panel attached to the top panel and including a plurality of arms extending radially from the interior panel, the plurality of arms shaped to fit through the horizontal slits formed through the plurality of side panels;

wherein in a collapsed configuration the bottom panel is located adjacent to the top panel such that the plurality of side panels are capable of pivoting about the arms of the interior panel to lie flat underneath the bottom panel; and wherein in a deployed configuration, the bottom panel is slidably moved along lengths of the plurality of side panels towards a bottom of the side panels to maintain the plurality of side panels in an upright position.

2. The display structure of claim 1, the plurality of side panels oriented radially around a center of the bottom panel and a center of the top panel.

3. The display structure of claim 1, wherein the interior panel is attached to the top panel at ends of the plurality of arms extending radially from the interior panel and through the horizontal slits of the plurality of side panels.

4. The display structure of claim 1, further comprising a plurality of alternating side panels shaped to slidably fit through the slits formed through the bottom panel and the slits formed through the top panel, the plurality of side panels including diagonal cuts on a lower end of the plurality of alternating side panels, the plurality of alternating side panels including a horizontal slit adjacent upper ends of the plurality of alternating side panels.

5. The display structure of claim 4, wherein the plurality of side panels comprise at least three side panels, and wherein the plurality of alternating side panels comprise at least three alternating side panels, the plurality of side panels and plurality of alternating side panels arranged alternatively around centers of the top panel and the interior panel.

6. The display structure of claim 4, wherein the display structure is moved from the deployed configuration to the collapsed configuration by:

sliding the bottom panel towards the top panel and interior panel along lengths of the plurality of side panels;

pivoting lower ends of the plurality of alternating side panels towards a center of the display structure such that the plurality of alternating side panels lie flat against an underside of the interior panel;

pivoting lower ends of the plurality of side panels towards the center of the display structure such that the plurality of side panels lie flat against the plurality of alternating side panels and underside of the interior panel.

7. The display structure of claim 1, further comprising an LED attached to an underside of the interior panel for illuminating the display structure when the display structure is in the deployed configuration.

8. The display structure of claim 1, further comprising one or more circular cutouts formed through the top panel and interior panel for receiving an object through the one or more circular cutouts.

9. The display structure of claim 1, further comprising printed indicia located on one of the top panel and plurality of side panels, the printed indicia selected from the group consisting of text, alphanumeric messages, visual images, pictures, graphics, symbols, and logos.

10. The display structure of claim 1, wherein the bottom panel, top panel, interior panel, and side panels are formed from one of plastic, vellum, cardstock, chipboard, cardboard, wood, and metal.

11. The display structure of claim 1, wherein the plurality of side panels comprise at least six side panels circularly arranged around centers of the top panel and interior panel.

12. The display structure of claim 1, wherein in the deployed configuration a hollow interior of the display structure is formed between the bottom panel, the interior panel, and the plurality of side panels.

13. A display structure comprising:

a bottom panel including a plurality of slits formed through the bottom panel and arranged around a center of the bottom panel;

a top panel including a plurality of slits formed through the top panel and arranged around a center of the top panel;

a plurality of first side panels shaped to slidably fit through the slits formed through the bottom panel and the slits formed through the top panel, the plurality of first side panels including lateral tabs located on a lower end of the plurality of side panels and having a width greater than a width of the plurality of slits formed through the bottom panel to prevent the plurality of side panels from passing through the plurality of slits formed through the bottom panel, the plurality of side panels further including a horizontal slit adjacent upper ends of the plurality of side panels;

a plurality of second side panels arranged alternately with the plurality of first side panels and shaped to slidably fit through the slits formed through the bottom panel and the slits formed through the top panel, the plurality of first side panels including diagonal cuts located on a lower end of the plurality of side panels and having a width less than a width of the plurality of slits formed through the bottom panel, the plurality of side panels further including a horizontal slit adjacent upper ends of the plurality of side panels;

an interior panel attached to the top panel and including a plurality of arms extending radially from the interior panel, the plurality of arms shaped to fit through the horizontal slits formed through the plurality of first side panels and the plurality of second side panels;

wherein in a collapsed configuration the bottom panel is located adjacent to the top panel such that the plurality of first side panels and plurality of second side panels are capable of pivoting about the arms of the interior panel to lie flat underneath the bottom panel; and wherein in a deployed configuration, the bottom panel is slidably moved along lengths of the plurality of side panels towards a bottom of the side panels to maintain the plurality of first side panels and plurality of second side panels in an upright position.

14. A display structure comprising:

a bottom panel including a plurality of slits formed through the bottom panel and arranged around a center of the bottom panel;

a top panel including a plurality of slits formed through the top panel and arranged around a center of the top panel;

a plurality of side panels shaped to slidably fit through the slits formed through the bottom panel and the slits formed through the top panel, the plurality of side panels including lateral tabs located on a lower end of the plurality of side panels to prevent the plurality of side panels from passing through the plurality of slits formed through the bottom panel, the plurality of side panels further including a horizontal slit adjacent upper ends of the plurality of side panels;

a plurality of arms shaped to fit through the horizontal slits formed through the plurality of side panels, the plurality of arms attached to the top panel;

wherein in a collapsed configuration the bottom panel is located adjacent to the top panel such that the plurality of side panels are capable of pivoting about the plurality of arms to lie flat underneath the bottom panel; and wherein in a deployed configuration, the bottom panel is slidably moved along lengths of the plurality of side panels towards a bottom of the side panels to maintain the plurality of side panels in an upright position.

* * * * *